US009182194B2

(12) United States Patent
Moore

(10) Patent No.: US 9,182,194 B2
(45) Date of Patent: Nov. 10, 2015

(54) FRONT-GRIP LIGHTING DEVICE

(71) Applicant: Larry E. Moore, Cottonwood, AZ (US)

(72) Inventor: Larry E. Moore, Cottonwood, AZ (US)

( * ) Notice: Subject to any disclaimer, the term of this patent is extended or adjusted under 35 U.S.C. 154(b) by 0 days.

(21) Appl. No.: 14/182,140

(22) Filed: Feb. 17, 2014

(65) Prior Publication Data

US 2015/0233668 A1 Aug. 20, 2015

(51) Int. Cl.
*F41G 1/35* (2006.01)
*F41C 23/16* (2006.01)

(52) U.S. Cl.
CPC .. *F41C 23/16* (2013.01); *F41G 1/35* (2013.01)

(58) Field of Classification Search
CPC ..... F41G 1/35; F41G 11/003; F41C 27/00; F41C 23/16
See application file for complete search history.

(56) References Cited

U.S. PATENT DOCUMENTS

| | | | |
|---|---|---|---|
| 1,898,566 | A | 2/1933 | Noel |
| 2,268,056 | A | 12/1941 | Nelson et al. |
| 2,357,951 | A | 9/1944 | Hale |
| 2,430,469 | A | 11/1947 | Karnes |
| 2,597,565 | A | 5/1952 | Chandler et al. |
| 2,773,309 | A | 12/1956 | Elliot |
| 2,780,882 | A | 2/1957 | Temple |
| 2,826,848 | A | 3/1958 | Davies |
| 2,844,710 | A | 7/1958 | Rudolf |
| 2,904,888 | A | 9/1959 | Niesp |
| 3,112,567 | A | 12/1963 | Flanagan |
| 3,192,915 | A | 7/1965 | Norris et al. |
| 3,284,905 | A | 11/1966 | Simmons |
| 3,510,965 | A | 5/1970 | Rhea |
| 3,526,972 | A | 9/1970 | Sumpf |
| 3,573,868 | A | 4/1971 | Giannetti |
| 3,641,676 | A | 2/1972 | Knutsen et al. |
| 3,645,635 | A | 2/1972 | Steck |
| 3,801,205 | A | 4/1974 | Eggenschwyler |
| 3,914,873 | A | 10/1975 | Elliott, Jr. et al. |
| 3,992,783 | A | 11/1976 | Dunlap et al. |
| 3,995,376 | A | 12/1976 | Kimble et al. |
| 4,026,054 | A | 5/1977 | Snyder |
| 4,079,534 | A | 3/1978 | Snyder |
| 4,102,059 | A | 7/1978 | Kimble et al. |
| 4,144,505 | A | 3/1979 | Angelbeck et al. |
| 4,146,329 | A | 3/1979 | King et al. |
| 4,148,245 | A | 4/1979 | Steffanus et al. |
| 4,156,981 | A | 6/1979 | Lusk |
| 4,168,588 | A | 9/1979 | Snyder |
| 4,220,983 | A | 9/1980 | Schroeder |

(Continued)

FOREIGN PATENT DOCUMENTS

| | | |
|---|---|---|
| BE | 1009564 | 5/1997 |
| EP | 1046877 | 10/2000 |
| FR | 862247 | 3/1941 |

OTHER PUBLICATIONS

EPO; Office Action dated Oct. 5, 2011 in Serial No. 09169459.

(Continued)

*Primary Examiner* — Michael David
(74) *Attorney, Agent, or Firm* — Snell & Wilmer LLP

(57) ABSTRACT

A fore grip for a firearm houses a light source and power source. The light source is preferably a laser and the power source is preferably one or more batteries. A first switch is connected to a PCB and can be moved to respective positions that correspond to each of various operating conditions, such as continuously on, continuously off, and on when a second switch is activated.

19 Claims, 3 Drawing Sheets

(56) References Cited

U.S. PATENT DOCUMENTS 4,222,564 A 9/1980 Allen
4,229,103 A 10/1980 Hipp
4,232,867 A 11/1980 Tate
4,233,770 A 11/1980 de Filippis et al.
4,234,911 A 11/1980 Faith
4,295,289 A 10/1981 Snyder
4,305,091 A 12/1981 Cooper
4,348,828 A 9/1982 Snyder
4,352,665 A 10/1982 Kimble et al.
4,481,561 A 11/1984 Lanning
4,488,369 A 12/1984 Van Note
4,541,191 A 9/1985 Morris et al.
4,567,810 A 2/1986 Preston
4,713,889 A 12/1987 Santiago
4,763,431 A 8/1988 Allan et al.
4,825,258 A 4/1989 Whitson
4,830,617 A 5/1989 Hancox et al.
4,876,816 A 10/1989 Triplett
4,878,307 A 11/1989 Singletary
4,891,476 A 1/1990 Nation et al.
4,934,086 A 6/1990 Houde-Walter
4,939,320 A 7/1990 Graulty
4,939,863 A 7/1990 Alexander et al.
4,945,667 A 8/1990 Rogalski et al.
4,953,316 A 9/1990 Litton et al.
4,967,642 A 11/1990 Mihaita
5,001,836 A 3/1991 Cameron et al.
5,033,219 A 7/1991 Johnson et al.
5,048,211 A 9/1991 Hepp
5,048,215 A 9/1991 Davis
5,052,138 A 10/1991 Crain
5,090,805 A 2/1992 Stawarz
5,177,309 A 1/1993 Willoughby et al.
5,178,265 A 1/1993 Sepke
5,179,124 A 1/1993 Schoenwald et al.
5,179,235 A 1/1993 Toole
5,208,826 A * 5/1993 Kelly ..... 372/107
5,228,427 A 7/1993 Gardner
5,237,773 A 8/1993 Claridge
5,241,146 A 8/1993 Priesemuth
5,272,514 A 12/1993 Dor
5,299,375 A 4/1994 Thummel et al.
5,343,376 A 8/1994 Huang
5,355,608 A 10/1994 Teetzel
5,355,609 A 10/1994 Schenke
5,365,669 A 11/1994 Rustick et al.
5,367,779 A 11/1994 Lee
5,373,644 A 12/1994 De Paoli
5,375,362 A 12/1994 McGarry et al.
5,388,335 A 2/1995 Jung
5,392,550 A 2/1995 Moore et al.
5,400,540 A 3/1995 Solinsky et al.
5,419,072 A 5/1995 Moore et al.
5,432,598 A 7/1995 Szatkowski
5,435,091 A 7/1995 Toole et al.
5,446,535 A 8/1995 Williams
5,448,834 A 9/1995 Huang
5,454,168 A 10/1995 Langner
5,455,397 A 10/1995 Havenhill et al.
5,467,552 A 11/1995 Cupp et al.
5,481,819 A 1/1996 Teetzel
5,488,795 A 2/1996 Sweat
D368,121 S 3/1996 Lam
5,499,455 A 3/1996 Palmer
5,509,226 A 4/1996 Houde-Walter
5,515,636 A 5/1996 McGarry et al.
5,531,040 A 7/1996 Moore
5,555,662 A 9/1996 Teetzel
5,557,872 A 9/1996 Langner
5,566,459 A 10/1996 Breda
5,581,898 A 12/1996 Thummel
5,584,137 A 12/1996 Teetzel
5,590,486 A 1/1997 Moore
5,598,958 A 2/1997 Ryan, III et al.
5,618,099 A 4/1997 Brubacher
5,621,999 A 4/1997 Moore
5,622,000 A 4/1997 Marlowe
5,669,174 A 9/1997 Teetzel
5,671,561 A 9/1997 Johnson et al.
5,685,106 A 11/1997 Shoham
5,685,636 A 11/1997 German
5,694,202 A 12/1997 Mladjan et al.
5,694,713 A 12/1997 Paldino
5,704,153 A 1/1998 Kaminski et al.
5,706,600 A 1/1998 Toole et al.
5,735,070 A 4/1998 Vasquez et al.
5,787,631 A 8/1998 Kendall
5,788,500 A 8/1998 Gerber
5,822,905 A 10/1998 Teetzel
5,842,300 A 12/1998 Cheshelski et al.
5,847,345 A 12/1998 Harrison
5,867,930 A 2/1999 Kaminski et al.
5,881,707 A 3/1999 Gardner
5,892,221 A 4/1999 Lev
5,896,691 A 4/1999 Kaminski et al.
5,905,238 A 5/1999 Hung
5,909,951 A 6/1999 Johnsen et al.
5,922,030 A 7/1999 Shank et al.
5,967,133 A 10/1999 Gardner
5,983,774 A 11/1999 Mihaita
6,003,504 A 12/1999 Rice et al.
6,023,875 A 2/2000 Fell et al.
6,035,843 A 3/2000 Smith et al.
6,146,141 A 11/2000 Schumann
6,151,788 A 11/2000 Cox et al.
6,219,952 B1 * 4/2001 Mossberg et al. ..... 42/70.01
6,230,431 B1 5/2001 Bear
6,237,271 B1 5/2001 Kaminski
6,282,829 B1 * 9/2001 Mossberg et al. ..... 42/70.11
6,289,624 B1 9/2001 Hughes et al.
6,293,869 B1 9/2001 Kwan
6,295,753 B1 10/2001 Thummel
6,301,046 B1 10/2001 Tai et al.
6,318,228 B1 11/2001 Thompson
6,327,806 B1 12/2001 Paige
6,345,464 B1 2/2002 Kim et al.
6,363,648 B1 4/2002 Kranich et al.
6,366,349 B1 4/2002 Houde-Walter
6,371,004 B1 4/2002 Peterson
6,385,893 B1 5/2002 Cheng
6,389,729 B2 5/2002 Rauch et al.
6,389,730 B1 5/2002 Millard
6,397,509 B1 6/2002 Langner
6,430,861 B1 8/2002 Ayers et al.
6,434,874 B1 8/2002 Hines
6,442,880 B1 9/2002 Allan
6,487,807 B1 12/2002 Kopman et al.
6,499,247 B1 12/2002 Peterson
6,526,688 B1 3/2003 Danielson et al.
6,568,118 B1 5/2003 Teetzel
6,572,375 B2 6/2003 Shechter et al.
6,575,753 B2 6/2003 Rosa et al.
6,578,311 B2 6/2003 Danielson et al.
6,579,098 B2 6/2003 Shechter
6,591,536 B2 7/2003 Houde-Walter et al.
6,606,797 B1 8/2003 Gandy
6,616,452 B2 9/2003 Clark et al.
6,622,414 B1 9/2003 Oliver et al.
6,631,580 B2 10/2003 Iafrate et al.
6,631,668 B1 10/2003 Wilson et al.
6,650,669 B1 11/2003 Adkins
6,671,991 B1 1/2004 Danielson
D487,791 S 3/2004 Freed
6,742,299 B2 6/2004 Strand
6,782,789 B2 8/2004 McNulty
6,854,205 B2 2/2005 Wikle et al.
6,931,775 B2 8/2005 Burnett
6,935,864 B2 8/2005 Shechter et al.
6,966,775 B1 11/2005 Kendir et al.
7,032,342 B2 4/2006 Pikielny
7,049,575 B2 5/2006 Hotelling
7,111,424 B1 9/2006 Moody et al.
7,121,034 B2 10/2006 Keng
7,134,234 B1 11/2006 Makarounis

(56) References Cited

U.S. PATENT DOCUMENTS 7,191,557 B2 3/2007 Gablowski et al.
D542,446 S 5/2007 DiCarlo et al.
7,218,501 B2 5/2007 Keely
7,237,352 B2 7/2007 Keely et al.
7,243,454 B1 7/2007 Cahill
7,260,910 B2 8/2007 Danielson
7,264,369 B1 9/2007 Howe
7,303,306 B2 12/2007 Ross et al.
7,305,790 B2 12/2007 Kay
7,329,127 B2 2/2008 Kendir et al.
7,331,137 B2 2/2008 Hsu
D567,894 S 4/2008 Sterling et al.
7,360,333 B2 4/2008 Kim
D570,948 S 6/2008 Cerovic et al.
RE40,429 E 7/2008 Oliver et al.
D578,599 S 10/2008 Cheng
7,441,364 B2 10/2008 Rogers et al.
7,453,918 B2 11/2008 Laughman et al.
7,454,858 B2 11/2008 Griffin
7,464,495 B2 12/2008 Cahill
7,472,830 B2 1/2009 Danielson
D586,874 S 2/2009 Moody et al.
7,490,429 B2 2/2009 Moody et al.
7,578,089 B1 8/2009 Griffin
7,584,569 B2 9/2009 Kallio
7,591,098 B2 9/2009 Matthews et al.
D602,109 S 10/2009 Cerovic et al.
7,603,997 B2 10/2009 Hensel et al.
D603,478 S 11/2009 Hughes
7,624,528 B1 12/2009 Bell et al.
7,627,976 B1 12/2009 Olson
7,644,530 B2 1/2010 Scherpf
7,652,216 B2 1/2010 Sharrah et al.
D612,756 S 3/2010 D'Amelio et al.
D612,757 S 3/2010 D'Amelio et al.
7,674,003 B2 3/2010 Sharrah et al.
7,676,975 B2 3/2010 Phillips et al.
7,685,756 B2 3/2010 Moody et al.
7,698,847 B2 4/2010 Griffin
7,703,719 B1 4/2010 Bell et al.
7,712,241 B2 5/2010 Teetzel et al.
D616,957 S 6/2010 Rievley et al.
7,726,059 B2 6/2010 Pikielny
7,726,061 B1 6/2010 Thummel
7,730,820 B2 6/2010 Vice et al.
7,743,546 B2 6/2010 Keng
7,743,547 B2 6/2010 Houde-Walter
7,753,549 B2 7/2010 Solinsky et al.
7,771,077 B2 8/2010 Miller
7,797,843 B1 9/2010 Scott et al.
7,805,876 B1 10/2010 Danielson et al.
7,818,910 B2 10/2010 Young
7,827,726 B2 * 11/2010 Stokes ..... 42/146
7,841,120 B2 11/2010 Teetzel et al.
7,880,100 B2 2/2011 Sharrah et al.
7,900,390 B2 3/2011 Moody et al.
7,913,439 B2 3/2011 Whaley
D636,049 S 4/2011 Hughes et al.
D636,837 S 4/2011 Hughes et al.
7,921,591 B1 4/2011 Adcock
7,926,218 B2 4/2011 Matthews et al.
7,997,023 B2 8/2011 Moore et al.
8,001,715 B2 * 8/2011 Stokes ..... 42/146
8,006,427 B2 8/2011 Blevins et al.
8,006,428 B2 8/2011 Moore et al.
8,028,460 B2 10/2011 Williams
8,028,461 B2 10/2011 NuDyke
8,050,307 B2 11/2011 Day et al.
8,056,277 B2 11/2011 Griffin
8,093,992 B2 1/2012 Jancie et al.
8,104,220 B2 1/2012 Cobb
D653,798 S 2/2012 Janice et al.
8,109,024 B2 2/2012 Abst
8,110,760 B2 2/2012 Sharrah et al.
8,132,354 B1 3/2012 Sellers et al.
8,136,284 B2 3/2012 Moody et al.
8,141,288 B2 * 3/2012 Dodd et al. ..... 42/84
8,146,282 B2 * 4/2012 Cabahug et al. ..... 42/85
8,151,504 B1 4/2012 Aiston
8,151,505 B2 4/2012 Thompson
8,166,694 B2 5/2012 Swan
8,172,139 B1 5/2012 McDonald et al.
D661,366 S 6/2012 Zusman
8,196,328 B2 6/2012 Simpkins
8,215,047 B2 7/2012 Ash et al.
8,225,542 B2 7/2012 Houde-Walter
8,225,543 B2 7/2012 Moody et al.
8,245,428 B2 8/2012 Griffin
8,245,434 B2 8/2012 Hogg et al.
8,256,154 B2 9/2012 Danielson et al.
8,258,416 B2 9/2012 Sharrah et al.
D669,552 S 10/2012 Essig et al.
D669,553 S 10/2012 Hughes et al.
D669,957 S 10/2012 Hughes et al.
D669,958 S 10/2012 Essig et al.
D669,959 S 10/2012 Johnston et al.
D670,785 S 11/2012 Fitzpatrick et al.
8,312,666 B2 11/2012 Moore et al.
D672,005 S 12/2012 Hedeen et al.
8,322,064 B2 12/2012 Cabahug et al.
8,335,413 B2 12/2012 Dromaretsky et al.
D674,861 S 1/2013 Johnston et al.
D674,862 S 1/2013 Johnston et al.
D675,281 S 1/2013 Speroni
8,341,868 B2 1/2013 Zusman
8,347,541 B1 1/2013 Thompson
8,356,818 B2 1/2013 Mraz
8,360,598 B2 1/2013 Sharrah et al.
D676,097 S 2/2013 Izumi
8,365,456 B1 2/2013 Shepard
D677,433 S 3/2013 Swan et al.
D678,976 S 3/2013 Pittman
8,387,294 B2 3/2013 Bolden
8,393,104 B1 3/2013 Moody et al.
8,393,105 B1 3/2013 Thummel
8,397,418 B2 * 3/2013 Cabahug et al. ..... 42/85
8,402,683 B2 3/2013 Cabahug et al.
8,413,362 B2 4/2013 Houde-Walter
D682,977 S 5/2013 Thummel et al.
8,443,539 B2 * 5/2013 Cabahug et al. ..... 42/85
8,444,291 B2 5/2013 Swan et al.
8,448,368 B2 5/2013 Cabahug et al.
8,458,944 B2 6/2013 Houde-Walter
8,467,430 B2 6/2013 Caffey et al.
8,468,734 B2 6/2013 Meller et al.
8,468,930 B1 6/2013 Bell
D687,120 S 7/2013 Hughes et al.
8,480,329 B2 7/2013 Fluhr et al.
8,484,880 B1 7/2013 Sellers et al.
8,484,882 B2 7/2013 Haley et al.
8,485,686 B2 7/2013 Swan et al.
8,510,981 B1 8/2013 Ganther et al.
8,516,731 B2 * 8/2013 Cabahug et al. ..... 42/84
8,567,981 B2 10/2013 Finnegan et al.
8,584,587 B2 11/2013 Uhr
D697,162 S 1/2014 Faifer
8,661,725 B1 3/2014 Ganther et al.
8,662,694 B1 * 3/2014 Izumi et al. ..... 362/114
8,734,156 B2 5/2014 Uhr
8,739,447 B2 6/2014 Merritt et al.
8,807,779 B1 * 8/2014 Izumi et al. ..... 362/114
8,844,189 B2 9/2014 Moore et al.
8,919,023 B2 12/2014 Merritt et al.
8,938,904 B1 1/2015 Sellers et al.
8,944,838 B2 2/2015 Mulfinger
2001/0042335 A1 11/2001 Strand
2002/0009694 A1 1/2002 Rosa
2002/0051953 A1 5/2002 Clark et al.
2002/0057719 A1 5/2002 Shechter
2002/0073561 A1 6/2002 Liao
2002/0129536 A1 9/2002 Iafrate et al.
2002/0134000 A1 9/2002 Varshneya et al.
2002/0194767 A1 12/2002 Houde Walter et al.
2003/0003424 A1 1/2003 Shechter et al.

(56) References Cited

U.S. PATENT DOCUMENTS

| | | | | |
|---|---|---|---|---|
| 2003/0029072 | A1 | 2/2003 | Danielson | |
| 2003/0175661 | A1 | 9/2003 | Shechter et al. | |
| 2003/0180692 | A1 | 9/2003 | Skala et al. | |
| 2003/0196366 | A1 | 10/2003 | Beretta | |
| 2004/0003529 | A1 | 1/2004 | Danielson | |
| 2004/0010956 | A1 | 1/2004 | Bubits | |
| 2004/0014010 | A1 | 1/2004 | Swensen et al. | |
| 2005/0044736 | A1 | 3/2005 | Liao | |
| 2005/0130739 | A1* | 6/2005 | Argentar | 463/36 |
| 2005/0153262 | A1 | 7/2005 | Kendir | |
| 2005/0185403 | A1 | 8/2005 | Diehl | |
| 2005/0188588 | A1 | 9/2005 | Keng | |
| 2005/0241209 | A1 | 11/2005 | Staley | |
| 2005/0257415 | A1 | 11/2005 | Solinsky et al. | |
| 2005/0268519 | A1 | 12/2005 | Pikielny | |
| 2006/0162225 | A1 | 7/2006 | Danielson | |
| 2006/0191183 | A1 | 8/2006 | Griffin | |
| 2007/0039226 | A1* | 2/2007 | Stokes | 42/146 |
| 2007/0041418 | A1 | 2/2007 | Laughman et al. | |
| 2007/0056203 | A1 | 3/2007 | Gering et al. | |
| 2007/0113460 | A1 | 5/2007 | Potterfield et al. | |
| 2007/0190495 | A1 | 8/2007 | Kendir et al. | |
| 2007/0258236 | A1 | 11/2007 | Miller | |
| 2007/0271832 | A1 | 11/2007 | Griffin | |
| 2008/0000133 | A1 | 1/2008 | Solinsky et al. | |
| 2008/0060248 | A1 | 3/2008 | Pine et al. | |
| 2008/0134562 | A1 | 6/2008 | Teetzel | |
| 2009/0013580 | A1 | 1/2009 | Houde-Walter | |
| 2009/0013581 | A1 | 1/2009 | LoRocco | |
| 2009/0178325 | A1 | 7/2009 | Veilleux | |
| 2009/0183416 | A1 | 7/2009 | Danielson | |
| 2009/0293335 | A1 | 12/2009 | Danielson | |
| 2009/0293855 | A1 | 12/2009 | Danielson et al. | |
| 2010/0058640 | A1 | 3/2010 | Moore et al. | |
| 2010/0162610 | A1 | 7/2010 | Moore et al. | |
| 2010/0175297 | A1 | 7/2010 | Speroni | |
| 2010/0229448 | A1 | 9/2010 | Houde-Walter | |
| 2010/0275496 | A1 | 11/2010 | Solinsky et al. | |
| 2011/0047850 | A1 | 3/2011 | Rievley et al. | |
| 2011/0061283 | A1 | 3/2011 | Cavallo | |
| 2011/0074303 | A1* | 3/2011 | Stokes | 315/250 |
| 2011/0162249 | A1 | 7/2011 | Woodmansee et al. | |
| 2011/0185619 | A1 | 8/2011 | Finnegan et al. | |
| 2012/0047787 | A1 | 3/2012 | Curry | |
| 2012/0055061 | A1 | 3/2012 | Hartley et al. | |
| 2012/0110886 | A1 | 5/2012 | Moore et al. | |
| 2012/0124885 | A1 | 5/2012 | Caulk et al. | |
| 2012/0144716 | A1* | 6/2012 | Cabahug et al. | 42/84 |
| 2012/0180366 | A1 | 7/2012 | Jaroh et al. | |
| 2012/0180367 | A1 | 7/2012 | Singh | |
| 2012/0180370 | A1 | 7/2012 | McKinley | |
| 2012/0224357 | A1 | 9/2012 | Moore | |
| 2013/0185978 | A1* | 7/2013 | Dodd et al. | 42/84 |
| 2013/0185982 | A1 | 7/2013 | Hilbourne et al. | |
| 2013/0263492 | A1 | 10/2013 | Erdle | |
| 2014/0007485 | A1* | 1/2014 | Castejon, Sr. | 42/117 |
| 2014/0109457 | A1 | 4/2014 | Speroni | |
| 2014/0355258 | A1* | 12/2014 | Izumi et al. | 362/114 |

OTHER PUBLICATIONS

EPO; Office Action dated Oct. 5, 2011 in Serial No. 09169469.
EPO; Office Action dated Dec. 20, 2011 in Application No. 09169476.
EPO; Office Action dated Sep. 3, 2012 in Application No. 09169469.
EPO; Office Action dated Sep. 3, 2012 in Application No. 09169476.
EPO; Office Action dated Sep. 3, 2012 in Application No. 09169459.
EPO; Search Opinion and Report dated Aug. 6, 2010 in Serial No. 09169459.
EPO; Search Opinion and Report dated Aug. 6, 2010 in Serial No. 0969469.
EPO; Search Opinion and Report dated Aug. 23, 2010 in Serial No. 09169476.
EPO; Search Report and Opinion dated Aug. 6, 2012 in Serial No. 11151504.
USPTO; Advisory Action dated Aug. 22, 2011 in U.S. Appl. No. 12/249,781.
USPTO; Advisory Action dated Jul. 13, 2012 in U.S. Appl. No. 12/249,781.
USPTO; Final Office Action dated Feb. 24, 2010 in U.S. Appl. No. 11/317,647.
USPTO; Final Office Action dated Mar. 6, 2012 in U.S. Appl. No. 12/610,213.
USPTO; Final Office Action dated May 2, 2012 in U.S. Appl. No. 12/249,781.
USPTO; Final Office Action dated Jun. 19, 2009 in U.S. Appl. No. 11/317,647.
USPTO; Final Office Action dated May 18, 2011 in U.S. Appl. No. 12/249,781.
USPTO; Final Office Action dated Aug. 7, 2012 in U.S. Appl. No. 12/249,781.
USPTO; Notice of Allowance dated Feb. 2, 2011 in U.S. Appl. No. 12/249,794.
USPTO; Notice of Allowance dated Feb. 26, 2002 in U.S. Appl. No. 09/624,124.
USPTO; Notice of Allowance dated Mar. 3, 2011 in U.S. Appl. No. 12/249,785.
USPTO; Notice of Allowance dated May 13, 2011 in U.S. Appl. No. 12/249,785.
USPTO; Notice of Allowance dated May 17, 2011 in U.S. Appl. No. 13/077,861.
USPTO; Notice of Allowance dated Jul. 8, 2011 in U.S. Appl. No. 12/249,794.
USPTO; Notice of Allowance dated Sep. 1, 2011 in U.S. Appl. No. 13/077,861.
USPTO; Notice of Allowance dated Nov. 1, 2011 in U.S. Appl. No. 13/077,875.
USPTO; Notice of Allowance dated Nov. 18, 2011 in U.S. Appl. No. 13/077,861.
USPTO; Notice of Allowance dated Jul. 25, 2012 in U.S. Appl. No. 12/610,213.
USPTO; Notice of Allowance dated Aug. 16, 2012 in U.S. Appl. No. 13/346,621.
USPTO; Office Action dated Jan. 26, 2012 in U.S. Appl. No. 12/249,781.
USPTO; Office Action dated Sep. 28, 2009 in U.S. Appl. No. 11/317,647.
USPTO; Office Action dated Oct. 6, 2010 in U.S. Appl. No. 12/249,794.
USPTO; Office Action dated Oct. 18, 2011 in U.S. Appl. No. 12/610,213.
USPTO; Office Action dated Nov. 8, 2010 in U.S. Appl. No. 12/249,781.
USPTO; Office Action dated Dec. 26, 2008 in U.S. Appl. No. 11/317,647.
USPTO; Office Action dated Jun. 11, 2001 in U.S. Appl. No. 09/624,124.
USPTO; Office Action dated Jun. 22, 2011 in U.S. Appl. No. 13/077,875.
USPTO; Office Action dated Nov. 15, 2012 in U.S. Appl. No. 13/412,385.
USPTO; Office Action dated Feb. 1, 2013 in U.S. Appl. No. 12/249,781.
USPTO; Office Action dated Feb. 20, 2013 in U.S. Appl. No. 13/670,278.
USPTO; Office Action dated Mar. 26, 2013 in U.S. Appl. No. 13/353,241.
USPTO; Final Office Action dated Sep. 24, 2013 in U.S. Appl. No. 13/353,241.
USPTO; Office Action dated Jan. 31, 2014 in U.S. Appl. No. 13/353,241.
USPTO; Final Office Action dated Sep. 10, 2014 in U.S. Appl. No. 13/353,241.
USPTO; Office Action dated Oct. 23, 2012 in U.S. Appl. No. 13/010,649.
USPTO; Final Office Action dated Apr. 11, 2013 in U.S. Appl. No. 13/010,649.

(56) References Cited

OTHER PUBLICATIONS

USPTO; Final Office Action dated May 16, 2013 in U.S. Appl. No. 13/412,385.
USPTO; Office Action dated Jun. 17, 2013 in U.S. Appl. No. 13/353,301.
USPTO; Notice of Allowance dated Jan. 18, 2012 in U.S. Appl. No. 13/353,301.
USPTO; Office Action dated Jun. 19, 2013 in U.S. Appl. No. 13/353,165.
USPTO; Final Office Action dated Jul. 29, 2014 in U.S. Appl. No. 13/353,165.
USPTO; Office Action dated Nov. 20, 2014 in U.S. Appl. No. 13/353,165.
USPTO; Final Office Action dated Jun. 24, 2013 in U.S. Appl. No. 13/670,278.
USPTO; Office Action dated Dec. 11, 2013 in U.S. Appl. No. 13/670,278.
USPTO; Notice of Allowance dated Apr. 25, 2014 in U.S. Appl. No. 13/670,278.
USPTO; Notice of Allowance dated Jul. 15, 2013 in U.S. Appl. No. 13/412,385.
USPTO; Office Action dated Nov. 4, 2013 in U.S. Appl. No. 13/412,385.
USPTO; Final Office Action dated Mar. 27, 2014 in U.S. Appl. No. 13/412,385.
USPTO; Office Action dated Sep. 30, 2014 in U.S. Appl. No. 13/412,385.
USPTO; Notice of Allowance dated Aug. 6, 2013 in U.S. Appl. No. 13/010,649.
USPTO; Notice of Allowance dated Jul. 22, 2013 in U.S. Appl. No. 12/249,781.
USPTO; Decision on Appeal dated Aug. 20, 2013 in U.S. Appl. No. 11/317,647.
USPTO; Office Action dated Jan. 27, 2014in U.S. Appl. No. 13/707,312.
USPTO; Notice of Allowance dated Jun. 11, 2014 in U.S. Appl. No. 13/707,312.
USPTO; Office Action dated Aug. 19, 2014 in U.S. Appl. No. 14/316,688.
USPTO; Final Office Action dated Jan. 27, 2015 in U.S. Appl. No. 14/316,688.
USPTO; Office Action dated Mar. 3, 2015 in U.S. Appl. No. 14/278,315.
Webpage print out from http://airgunexpress.com/Accessories/ referencing various level devices.
Webpage print out from http://secure.armorholdings.com/b-square/smarthtml/about.html referencing background on B-Square and their firearm accessories.
Webpage print out from http://secure.armorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.
Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated "Update on the .25 SAUM" Jul. 2005 pp. 14-15.

* cited by examiner

FRONT-GRIP LIGHTING DEVICE

FIELD OF THE INVENTION

The present invention is generally directed to a lighting device for a firearm that is positioned in a front grip of the firearm.

BACKGROUND OF THE INVENTION

Vertical fore grips have become popular with firearms, such as rifles and machine pistols. A fore grip provides the operator with a front handle to both support and help aim the firearm. Fore grips usually include an elongated handle that can be gripped by the hand not operating the trigger. Often, the fore grip is removable and attached to the firearm by a bracket that attaches to a rail (such as a picatinny rail) underneath the firearm.

In addition to elongated handles, vertical fore grips have included other variations such as bipods or tripods to support the firearm while firing it.

Often the rail type brackets underneath the firearm are used to support accessories such as lights. However, using a removable fore grip takes away the space that has been used for the accessory lights. Thus, operators often have to choose whether to use the removable fore grips on the bottom facing rails or use accessory lights. To generally solve this problem it has been known to attach lights to vertically-extending fore grips, but the operation of same has been limited.

The disclosures of U.S. Pat. No. 8,127,485 entitled "GUN WITH MOUNTED SIGHTING DEVICE" to Moore et al., U.S. Pat. No. 8,312,665 entitled "SIDE-MOUNTED LIGHTING DEVICE" to Moore et al. and U.S. patent application Ser. No. 13/707,312 entitled "SIGHTING DEVICE REPLICATING SHOTGUN PATTERN SPREAD" to Moore et al. are incorporated herein by reference.

SUMMARY OF THE INVENTION

The present invention relates to a fore grip that can be attached to or integrally formed with a firearm and that includes a light source and a power source housed within the fore grip. The fore grip preferably has a portion generally parallel to the gun barrel and a downward-angled portion, rather than just extending vertically downward from the gun barrel. The light source preferably is a laser and has at least three operating conditions: a first condition wherein the light source is constantly on, a second condition wherein the light source is constantly off, and a third condition wherein the light source is turned on by a second switch. A first switch is moveable between three positions, wherein each of the positions corresponds to one of the three operating conditions. At least one second switch is provided that can be activated in any suitable manner (such as by pressing the second switch). To use the light source, the user moves the first switch to either the first position wherein the light source is constantly on or the third position in which the light source is activated when the second switch is activated. In one embodiment, there are two second switches, one on each side of the fore grip, so that a user can press either of the second switches to activate the light source when the first switch is in the third position.

DETAILED DESCRIPTION OF PREFERRED EMBODIMENTS

Figure 1:
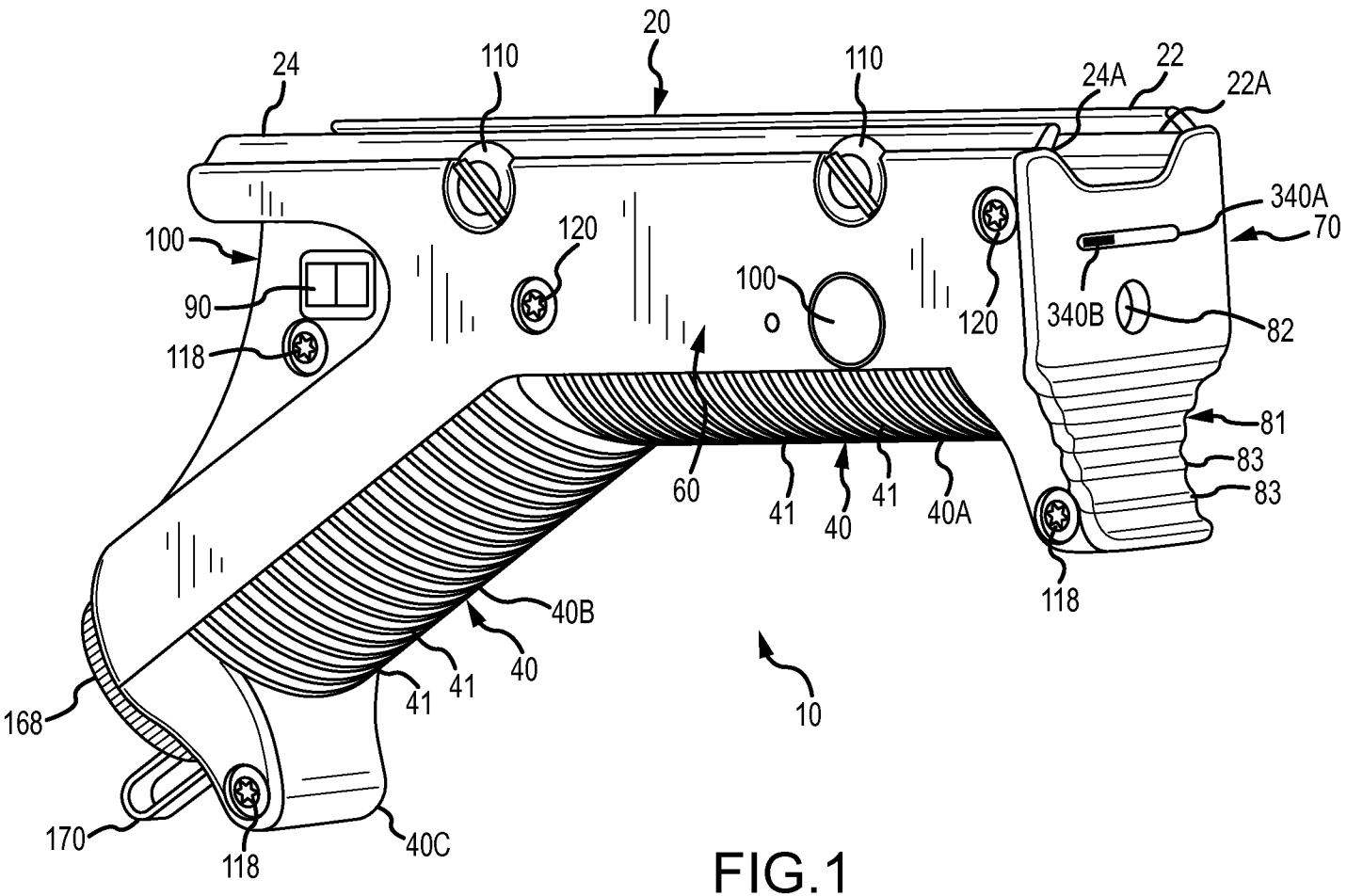
FIG. 1 is a side, perspective view of a fore grip according to aspects of the invention.

Turning now to the drawings, where the purpose is to describe preferred embodiments of the invention and not to limit same, FIG. 1 shows a fore grip 10 according to aspects of the invention. Fore grip 10 has a top portion 20, a bottom portion 40, two side portions 60 and 70, a front portion 80 and rear portion 100. Top portion 20 in this embodiment is designed to fit on the picatinny rail of a firearm, although any suitable method of attachment may be used. Top portion 20 has a first rail 22 and a second rail 24 opposite first rail 22. A groove 22A is at the base of first rail 22 and a groove 24A is at the base of second rail 24. The grooves 22A and 24A oppose one another, and the picatinny rail (not shown) of a firearm is received between the two. Bottom portion 40 as shown has a first portion 40A, which is preferably substantially parallel with the gun barrel when fore grip 10 is mounted on a fire arm, a second portion 40B, which is preferably formed at an angle of about 20° to 45°, and most preferably about 30°, to portion 40A, and a third portion 40C that extends downward and outward at either a vertical or 10°-45° angle away from portion 40B to create support for, and an easy way to properly position on the fore grip, a user's hand.

Fore grip 10 also includes a front grip (or fourth) portion 81 that extends downward from the front of portion 40A and provides an additional gripping surface. Front grip portion 81 may include ridges 83 to facilitate a better grip.

As shown, each of sections 40A and 40B include grooves 41 that assist a user in gripping the fore grip 10 and any suitable structure or surface texturing may be used for this purpose.

Bolts 110 pass through apertures 112 of side 60 and 114 of side 70 and are threaded into nuts 116. In this manner, bolts 110 and nuts 116 tighten grooves 22A and 24A against the picatinny rail of a firearm, although any suitable method or structure for affixing fore grip 10 to a firearm may be used.

To attach casing sides 60 and 70, fasteners 118 and 120 are utilized and pass through apertures in side 60 to be received in bosses 119 (which receive fasteners 118) and bosses 121 (which receive fasteners 120).

Figure 3:
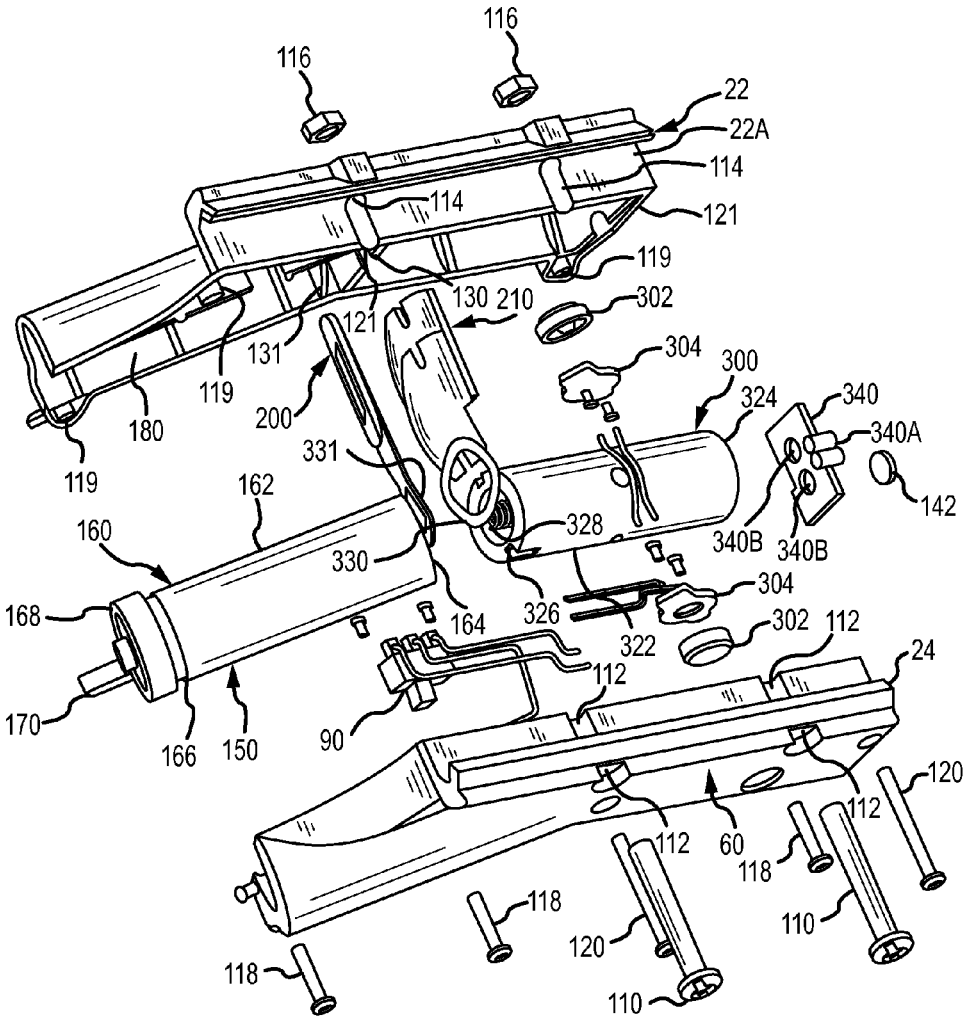
FIG. 3 is an exploded view of the fore grip according to FIG. 1.

A first switch 90 is in communication with the battery module printed circuit board (or PCB) 200 and the laser module PCB 210, each of which are best seen in FIG. 3. In this embodiment the first switch has three positions wherein each position alters the functioning of the battery module PCB 200 and the laser module PCB 210 to enable the laser module 300 to function in one of three ways: (1) continuously off; (2) continuously on; or (3) on only when one of the second switches is pressed. When activated to be on, the laser may pulse to save power, such as by rapidly pulsing off and on at about 500-2000, or about 1000 times per second, at about a 50% duty cycle, although any suitable pulse rate and duty cycle may be used to save power while still providing a laser light beam adequate to sight a target.

One or more second switches 100 can be located at any suitable position on fore grip 10. The purpose of second switch(es) 100 is to communicate with the laser module PCB 210 and activate the laser module 300 when power is available to module 300 because first switch 90 is in its third position. Most preferably switch(es) 100 are momentary switches that are pressed by a user's finger. In the embodiment shown there is a switch 100 on either side, 60 and 70, of fore grip 10. Preferably, switches 100 function so that the laser module 300 is activated if either of switches 100 are pressed. Alternatively, the laser module 300 can be activated only when both second switches 100 are pressed simultaneously (such as simultaneously by the thumb and forefinger of one hand). That manner of operation helps prevent a user from accidentally activating the laser module 300. Further, any of the one or more second switch(es) 100 may be another type of switch, such as a slide switch.

Figure 2:
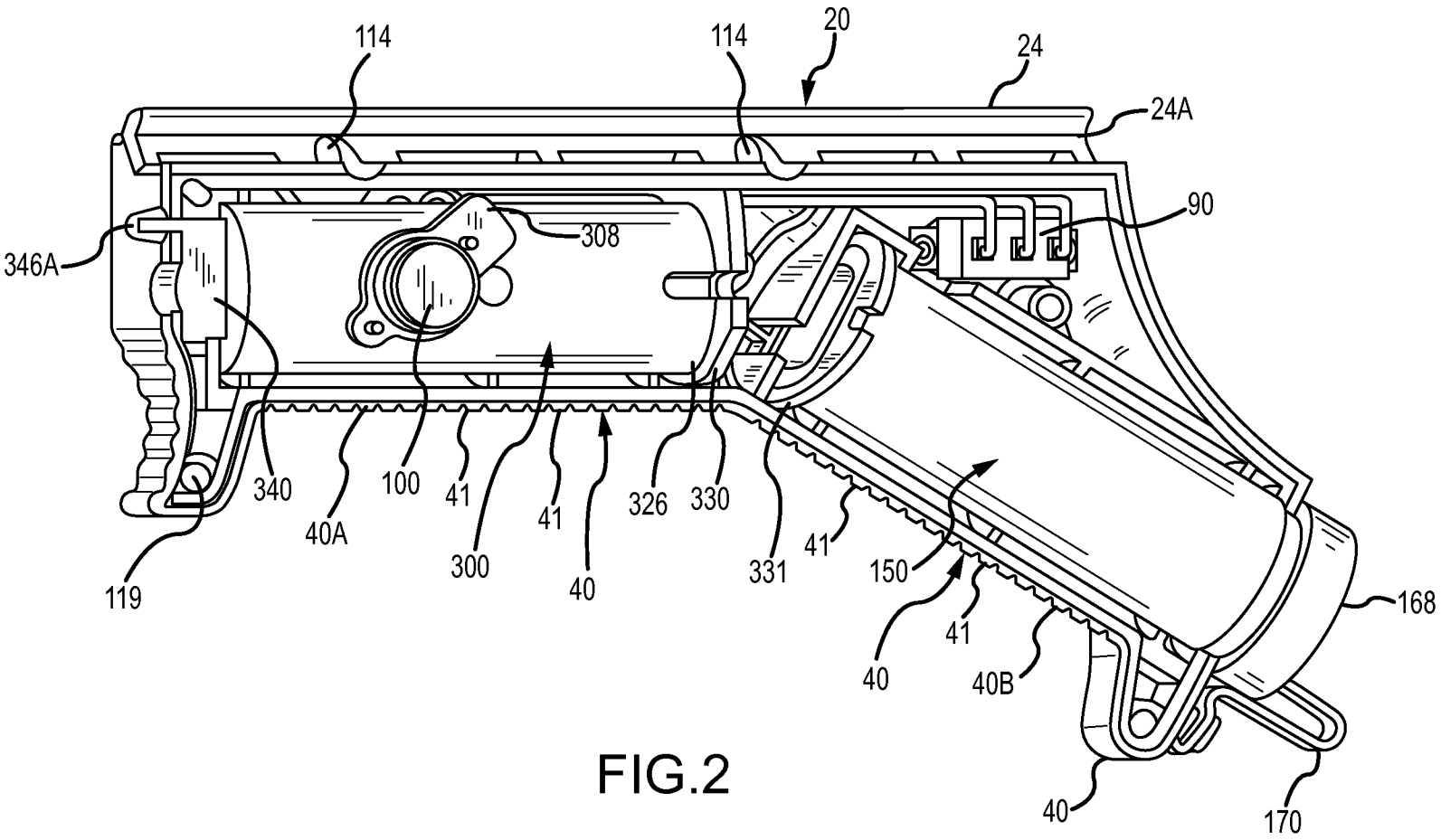
FIG. 2 is a side view of the fore grip according to FIG. 1 with the side of the casing removed to expose the inside.

Second switch(es) 100 are preferably mounted on either side of laser module 300 and include a switch button 302 and a switch board 304, wherein a pad (not shown) is mounted on switch board 304 and is in communication with module 300. As shown best in FIG. 2, wires 308 connect each switch 100 to laser module PCB 210.

Laser module 300 comprises an outer housing 320 that protects an internal laser module (not shown). Outer housing 320 has an annular outer surface 322, a first end 324 having an opening (not shown) through which laser light can pass, and a second end 326 that exposes a spring 328 or other biasing device that is connected to the laser module and (in this embodiment) provides a negative electrical contact. A wave washer 330 is between second end 328 and an internal wall 130 adjacent one of the bosses 121 to pressure fit laser module 300 into place and against laser module PCB 200. A lens (not shown) is at the end of the internal laser module and laser light is projected thorough the lens when the module 300 is activated. The laser light passes through an opening 82 is the front surface 80 of fore grip 10.

As shown, positioned inside of fore grip 10 between first end 324 of laser module 300 and aperture 82 is a laser lens slide 340. Slide 340 is manually moved by a user between a first position wherein the laser light passes through an opening 340B and a second position wherein the laser light passes through another opening 340B. A user moves slide 340 by manually manipulating projection 340A, which extends outward from slot opening 350.

In this embodiment opening 340A had no lens and laser light passing through opening 340A is in a straight beam without interruption. Opening 340B includes a lens 142 that alters the laser light existing the internal laser module, such as to create a pattern of light, such as a cross hair, vertical beam, horizontal beam, circular pattern of light beams, or circular pattern of light beams with a light beam in the center of the circumference of the circular pattern. Alternatively, there need not be a lens slide or the lens slide may have one or more different types of lenses than the ones described herein.

Power module 150 has an outer housing 160 that receives one or more batteries (not shown), which is preferably one 3V lithium photo cell battery, but could be any suitable battery (ies) or power source, and is preferably a 3V power source. Outer housing 160 has an annular outer surface 162, a first end 164 and a second end 166. A cap 168 is removalby attached to second end 166 preferably by being threadingly received, and is attached to the outer-casing of fore grip 10 by strap 170. Cap 168 can be removed to remove and/or add batteries to power module 150. Cap 168 and strap 170 are preferably comprised of any suitable plastic while modules 150 and 300 are preferably comprised of aluminum. Power module 150 fits in cavity 180 and is pressure fit against wave washer 331, which presses against wall 131 and biases module 150 towards power module PCB 210 and provides a negative contact.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A fore grip of a firearm, the fore grip comprising: (a) a light source; (b) a power source physically separated from and behind the light source, wherein the power source provides power for activating the light source; (c) a first PCB in electrical communication with a first switch and the power source; (d) a second PCB in electrical communication with the first PCB and the light source; (e) a first switch to activate the power source wherein the first switch has a first position wherein the light source is constantly off, a second position wherein the light source is constantly on, and a third position wherein the light source is on when a second switch is activated; (f) wherein the fore grip has a first section that is attached to a gun and the light source is positioned inside of the first section; and (g) wherein the fore grip has a second section that extends downward at an angle from the first section and the power source is positioned in the second section.

2. The fore grip of claim 1 wherein the light source is a laser module.

3. The fore grip of claim 2 wherein the second switch is mounted on the laser module.

4. The fore grip of claim 1 wherein the second switch is mounted on the light source.

5. The fore grip of claim 1 that includes a plurality of second switches and when the first switch is in its third position the light source can be activated by activating any of the plurality of second switches.

6. The fore grip of claim 1 that includes two second switches that are activated simultaneously to activate the light source when the first switch is in its third position.

7. The fore grip of claim 6 wherein both second switches are momentary switches.

8. The fore grip of claim 1 wherein the second switch is a momentary switch.

9. The fore grip of claim 1 wherein the light source is a laser module.

10. The fore grip of claim 9 wherein the laser module has a first end though which laser light is emitted, and further includes a lens slide juxtaposed the first end wherein the lens slide includes a plurality of openings and at least one opening includes a lens that modifies the travel of laser light passing through it, the slide movable to at least one position at which laser light emitted from the first end of the laser module passes through one of the plurality of openings.

11. The fore grip of claim 10 wherein at least one lens in the lens slide modifies the laser light emitted from the laser module into a circular pattern of individual laser light beams.

12. The fore grip of claim 9 that includes a plurality of second switches wherein when the first switch is in its third position the light source can be activated by activating any of the plurality of second switches.

13. The fore grip of claim 1 wherein the light source is positioned in a first cavity of the fore grip.

14. The fore grip of claim 1 wherein the power source is positioned in a second cavity of the fore grip.

15. The fore grip of claim 1 wherein the power source is one or more batteries.

16. The fore grip of claim 1 wherein the first switch is a slide switch.

17. The fore grip of claim 1 that has an outer housing having a first half connected to a second half.

18. The fore grip of claim 1 wherein the first PCB and second PCB are physically separated.

19. The fore grip of claim 1 that has an attachment portion configured to attach to the picatinny rail of a firearm.

* * * * *